US011871804B2

(12) United States Patent
Grimm et al.

(10) Patent No.: US 11,871,804 B2
(45) Date of Patent: Jan. 16, 2024

(54) GARMENT AND GARMENT LINER

(71) Applicant: Sasquatch Running Company, LLC, Seattle, WA (US)

(72) Inventors: Stephanie Marie Grimm, Gig Harbor, WA (US); Thorin Beck Kane, Gig Harbor, WA (US)

(73) Assignee: Sasquatch Running Company, LLC, Seattle, WA (US)

( * ) Notice: Subject to any disclaimer, the term of this patent is extended or adjusted under 35 U.S.C. 154(b) by 0 days.

(21) Appl. No.: 18/310,437

(22) Filed: May 1, 2023

(65) Prior Publication Data

US 2023/0346059 A1 Nov. 2, 2023

Related U.S. Application Data

(60) Provisional application No. 63/337,458, filed on May 2, 2022.

(51) Int. Cl.

| | |
|---|---|
| ***A41B 9/02*** | (2006.01) |
| ***A41D 27/02*** | (2006.01) |
| ***A41D 27/20*** | (2006.01) |
| ***A41B 9/00*** | (2006.01) |

(52) U.S. Cl.
CPC ..... *A41D 27/02* (2013.01); *A41B 9/001* (2013.01); *A41D 27/20* (2013.01)

(58) Field of Classification Search
CPC ..... A41B 9/023; A41B 9/02; A41D 27/02
See application file for complete search history.

(56) References Cited

U.S. PATENT DOCUMENTS

| | | | | |
|---|---|---|---|---|
| 4,195,630 | A * | 4/1980 | Connery | A41B 9/023 2/403 |
| 5,070,869 | A * | 12/1991 | Zhang | A41B 9/02 2/403 |
| 7,676,853 | B1 * | 3/2010 | Cutlip | A41B 9/023 2/403 |
| 7,788,739 | B1 * | 9/2010 | Della Ratta | A41B 9/023 2/403 |
| 7,958,571 | B2 | 6/2011 | Kitsch et al. | |
| 9,687,030 | B2 | 6/2017 | Bigney et al. | |
| RE46,892 | E | 6/2018 | Bigney et al. | |
| 10,034,496 | B2 | 7/2018 | Bigney et al. | |

(Continued)

FOREIGN PATENT DOCUMENTS

| | | |
|---|---|---|
| CA | 138997 S | 3/2012 |
| CA | 2729368 C | 4/2019 |
| CA | 2747893 C | 9/2019 |

*Primary Examiner* — Tajash D Patel
(74) *Attorney, Agent, or Firm* — Kilpatrick Townsend & Stockton LLP

(57) ABSTRACT

A garment includes an outer shell with a liner coupled to the outer shell and arranged inside the outer shell. The liner includes a first panel and a second panel coupled to the outer shell. The first panel and the second panel are coupled to each other at a first seam positioned at an interface between the first and second panels. The first seam is configured to be located proximate a perineum of a user. A third panel is coupled to the second panel at the first seam and to the first panel at a second seam. The first panel and the third panel cooperate to define a pouch with an opening through the panel and leading into the pouch to allow a user to insert their genitalia into, and be supported by, the pouch.

18 Claims, 10 Drawing Sheets

(56) References Cited

U.S. PATENT DOCUMENTS

| | | | | |
|---|---|---|---|---|
| 10,085,492 | B2 | 10/2018 | Polidan et al. | |
| 10,750,792 | B2 * | 8/2020 | Hierholzer | A41B 9/023 |
| 2009/0064388 | A1 * | 3/2009 | Baiany | A41D 27/02 2/67 |
| 2020/0375274 | A1 * | 12/2020 | McNally | A41D 1/089 |
| 2021/0274869 | A1 * | 9/2021 | McNally | A41D 27/02 |

* cited by examiner

GARMENT AND GARMENT LINER

CROSS-REFERENCES TO RELATED APPLICATIONS

This application claims the benefit of U.S. Provisional Patent Application No. 63/337,458, filed May 2, 2022, the entire contents of which are hereby incorporated by reference for all purposes in its entirety.

BACKGROUND

Technical Field

The present disclosure is directed to a garment and a garment liner and is particularly, but not exclusively, directed to a garment liner for supporting male anatomy.

Description of the Related Art

Garments with liners are known. For example, conventional running shorts include an outer layer of fabric and an interior liner where the liner is intended to increase comfort for the user. For users with a male anatomy, the liner of known running shorts is intended to provide support for their genitalia during exercise. However, known running shorts and other garments with liners suffer from a number of deficiencies.

For example, men's and women's liners are similarly designed, despite the anatomical differences between these users. For users with a male anatomy, there is a tendency with typical running shorts for the genitalia to contact and stick to the inner thigh. Further, conventional running shorts create a high degree of contact and friction between the inner thighs of the wearer which can lead to chafing and discomfort while running, walking, and sitting. The design of known liners limits freedom of movement and the natural resting position for male genitalia while also creating the potential for the genitalia to slip out of the liner.

Various solutions have been proposed in response to the above issues, but none satisfactorily overcome the disadvantages of conventional running shorts and other garments with liners above. For example, users may wear compression shorts or boxer briefs under, or in place of, running shorts. These compression shorts or boxer briefs are designed to be tight and form-fitting, which provides support for the male genitalia. However, compression shorts and boxer briefs also constrict the genitalia extremely close to the body, which does not solve the issues above regarding contact between the genitalia and the inner thighs and legs. Indeed, compression shorts may actually increase instances of these issues in some cases. If compression shorts are worn without corresponding running shorts over the compression shorts, much of the wearer's anatomy is revealed. As a result, this is likewise an incomplete solution.

Other liner designs may provide some support without the constriction issues posed by compression shorts, but such liner designs do not allow the genitalia room to rest naturally. As a result, the genitalia sit within and press against the liner, which causes the seams of the liner to dig into the genitalia and cause immense discomfort. For some users, the position of their genitalia within a typical liner has the effect of stretching the liner away from the body, which reduces support and allows for the genitalia to slip out of the liner during movement. The genitalia must then be reinserted into the liner, which disrupts the activity and focus of the user, or if the genitalia are not inserted back into the liner, additional discomfort for the user.

Accordingly, it would be advantageous to have a garment and garment liner that overcomes the disadvantageous of known garments and garment liners.

BRIEF SUMMARY

The present disclosure is generally directed to a garment with an outer shell and a liner stitched to the outer shell. The liner is positioned internal to the outer shell and includes a first panel (e.g., a front panel) and a second panel (e.g., a rear panel) both coupled to the outer shell. The panels define two openings in the liner through which a user can insert their legs with the openings spaced from each other across a portion of material of each of the first panel and the second panel. The first panel and the second panel are coupled to each other by a first seam that extends across the portion of material between the openings in the panels. The first seam is structured to be positioned proximate at least a part of a perineum of a user during use. A third panel (e.g., a pouch panel) overlays a portion of the first panel. The third panel is coupled to the second panel at or nearby the first seam and coupled to the first panel at a second seam.

The first panel and the third panel define a pouch with the third panel being located between the outer shell and the first panel, and with the first panel facing inward toward the second panel and the user during operation. An opening extends through the first panel to provide access to the pouch. In operation, a user inserts their genitalia into the opening in the first panel to be received in the pouch. The location of the opening and the first and second seams, along with the remaining boundaries of the pouch generally, allow the genitalia to be supported in a comfortable, natural position. Further, the pouch is confined and closed except for the opening in the first panel. This arrangement can help prevent the genitalia from falling out of the pouch. The first and third panels also provide a layer of material between the user's thighs and genitalia to reduce discomfort and chafing.

BRIEF DESCRIPTION OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale in some figures. For example, the shapes of various elements may be selected, enlarged, and positioned to improve drawing legibility or the sizes and relative positions of elements in the drawings may be exactly to scale. The particular shapes of the elements as drawn may have been selected for ease of recognition in the drawings. The figures do not describe every aspect of the teachings disclosed herein and do not limit the scope of the claims.

DETAILED DESCRIPTION

Persons of ordinary skill in the art will understand that the present disclosure is illustrative only and not in any way limiting. Other embodiments of the presently disclosed systems and methods readily suggest themselves to such skilled persons having the assistance of this disclosure.

Each of the features and teachings disclosed herein can be utilized separately or in conjunction with other features and teachings to provide garment and garment liner devices, systems, and methods. Representative examples utilizing many of these additional features and teachings, both separately and in combination, are described in further detail with reference to attached FIGS. 1-7. This detailed description is merely intended to teach a person of skill in the art further details for practicing aspects of the present teachings and is not intended to limit the scope of the claims. Therefore, combinations of features disclosed in the detailed description may not be necessary to practice the teachings in the broadest sense, and are instead taught merely to describe particularly representative examples of the present teachings.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced, but are not intended to limit the dimensions and the shapes shown in the examples in some embodiments. In some embodiments, the dimensions and the shapes of the components shown in the figures may be exactly to scale and intended to limit the dimensions and the shapes of the components.

While the description and accompanying figures describe certain non-limiting examples of running shorts with a liner to illustrate the concepts of the disclosure, it is to be appreciated that the garments and garment liners of the disclose can be applied equally to a number of other garments and items. For example, the concepts of the disclosure could be applied equally to briefs and underwear, boxer briefs, boxers, swimming shorts, general purpose athletic or training shorts, casual or non-athletic shorts, golf shorts, basketball shorts, biking shorts, and other like items. Accordingly, the present disclosure is not limited solely to liners for running shorts.

Figure 1A:
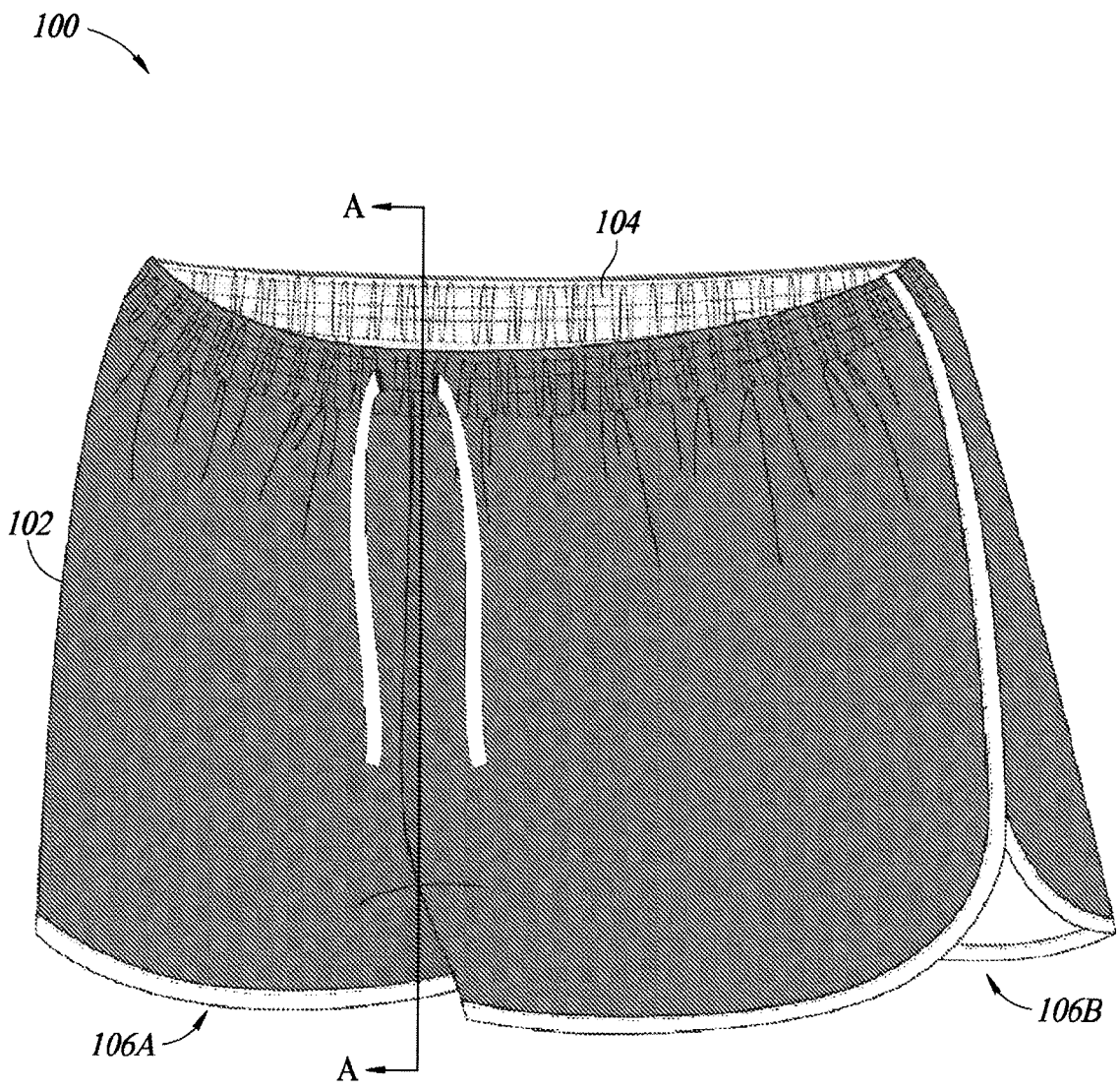
FIG. 1A is a front perspective view in accordance with various embodiments of a garment according to the present disclosure.
Figure 1B:
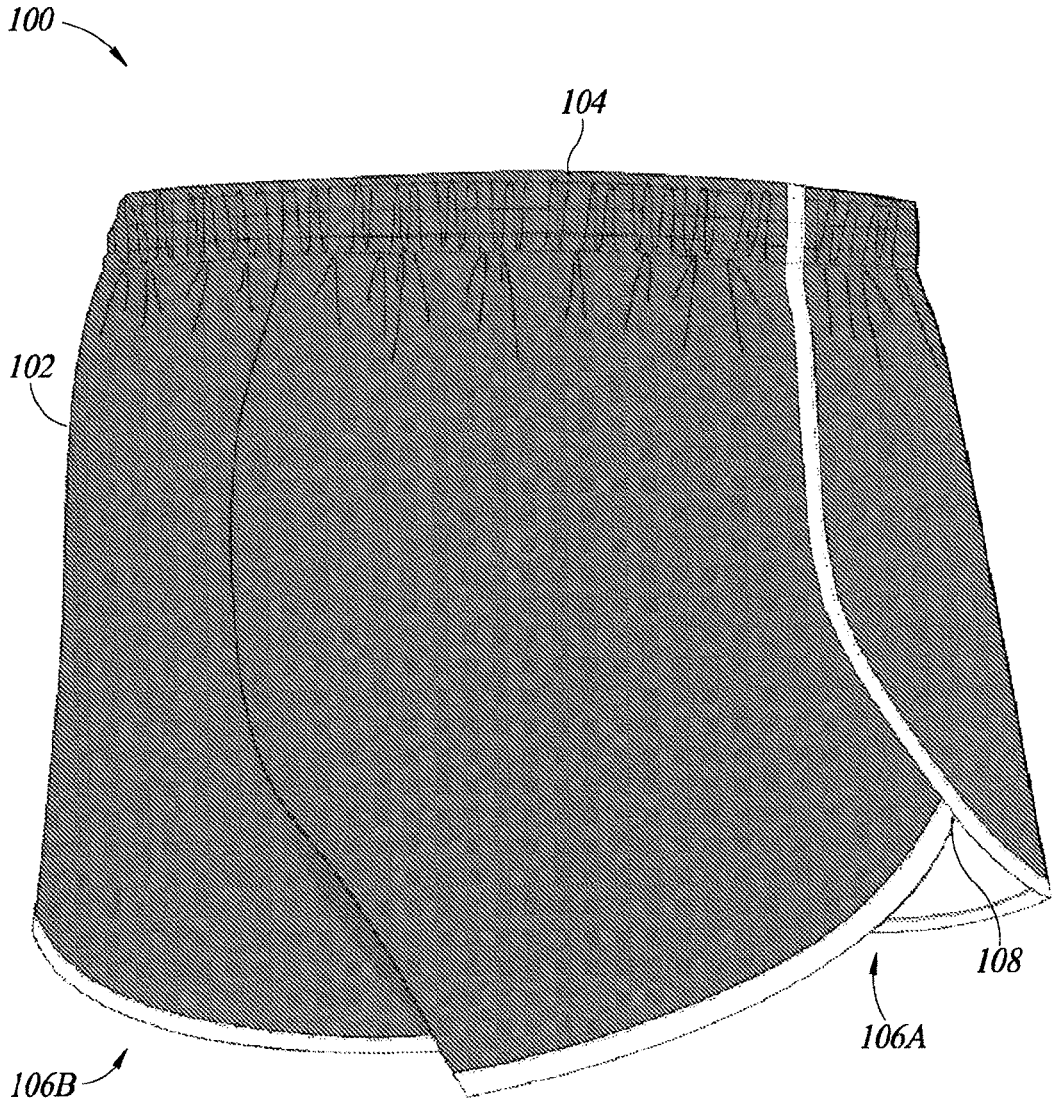
FIG. 1B is a rear perspective view of the garment of FIG. 1A.

FIG. 1A and FIG. 1B are front and rear perspective views, respectively, of various embodiments of a garment 100. With reference to FIG. 1A and FIG. 1B, the garment 100 may be a pair of running shorts with an outer shell 102 that includes a number of panels of material coupled to each other. The material of the outer shell can be selected from a number of different available materials, and may include nylon, polyester, spandex (sometimes called elastane), moisture wicking materials, waterproof or water-resistant materials, or any combination of these and/or other materials in some examples. The outer shell may include, or be coupled to, an elastic waistband 104 with the shell 102 defining openings 106A, 106B through which a user can insert their legs when wearing the garment 100. The outer shell 102 may have a selected size and shape according to a size or intended use of the garment 100 (i.e., as running shorts, athletic shorts, etc.), among other factors.

Further, the panels of the outer shell 102 may at least partially overlap each other (e.g., without being coupled to each other) at an interface 108 between panels proximate an outer side of each of the openings 106A, 106B, as best shown in FIG. 1B. The overlapping of the outer shell 102 at the interface 108 provides the outer shell 102 with a wider range of motion to make the outer shell 102 more comfortable for the user during activity.

Figure 2:
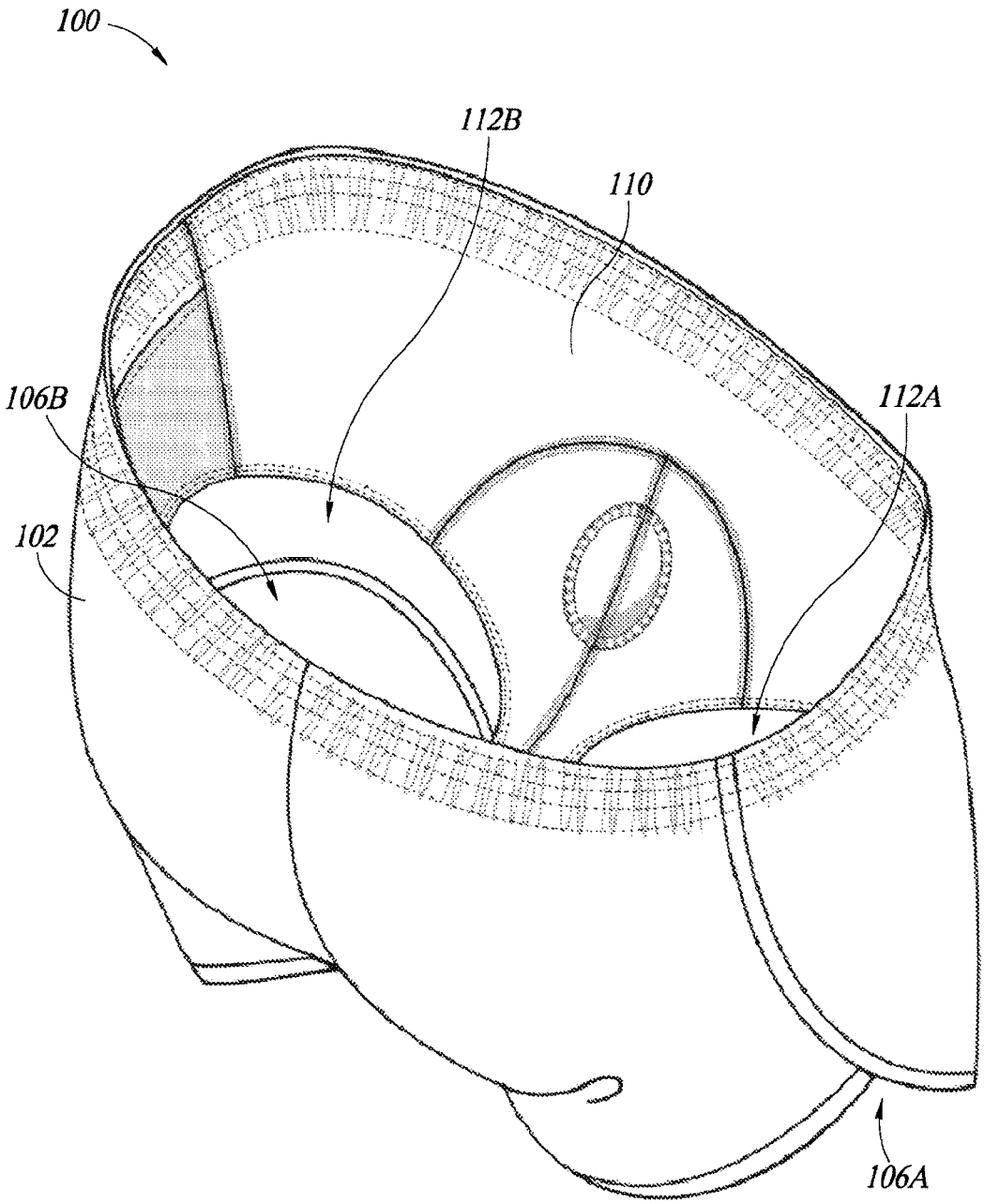
FIG. 2 is a top perspective view of a liner of the garment of FIG. 1A in accordance with various embodiments.

FIG. 2 is a top perspective view of the garment 100 illustrating a liner 110 coupled to the outer shell 102. The outer shell 102 may also be referred to herein as an outer body 102, an outer layer 102, or a first layer 102 with the liner 110 also referred to herein as a liner brief 110, a brief 110, an inner layer 110, or a second layer 110. The liner 110 is positioned inside the outer shell 102 or internal to the outer shell 102 as shown in FIG. 2. In various embodiments, the liner 110 is coupled to the outer shell 102 at the waistband 104, such that both the outer shell 102 and the liner 110 have an adjustable or flexible size via the waistband 104. The material of the liner 110 may be the same as the outer shell 102, or the liner 110 may selected to be a different material described herein. In various embodiments, both the outer shell 102 and the liner 110 are a flexible, stretchable fabric to accommodate motion and movement of the user. As will be explained in more detail below, the liner 110 includes first and second openings 112A, 112B that are generally aligned with the openings 106A, 106B through the outer shell 102 such that the user can likewise insert their legs through the openings 112A, 112B of the liner 110 when wearing the garment 100.

Figure 3:
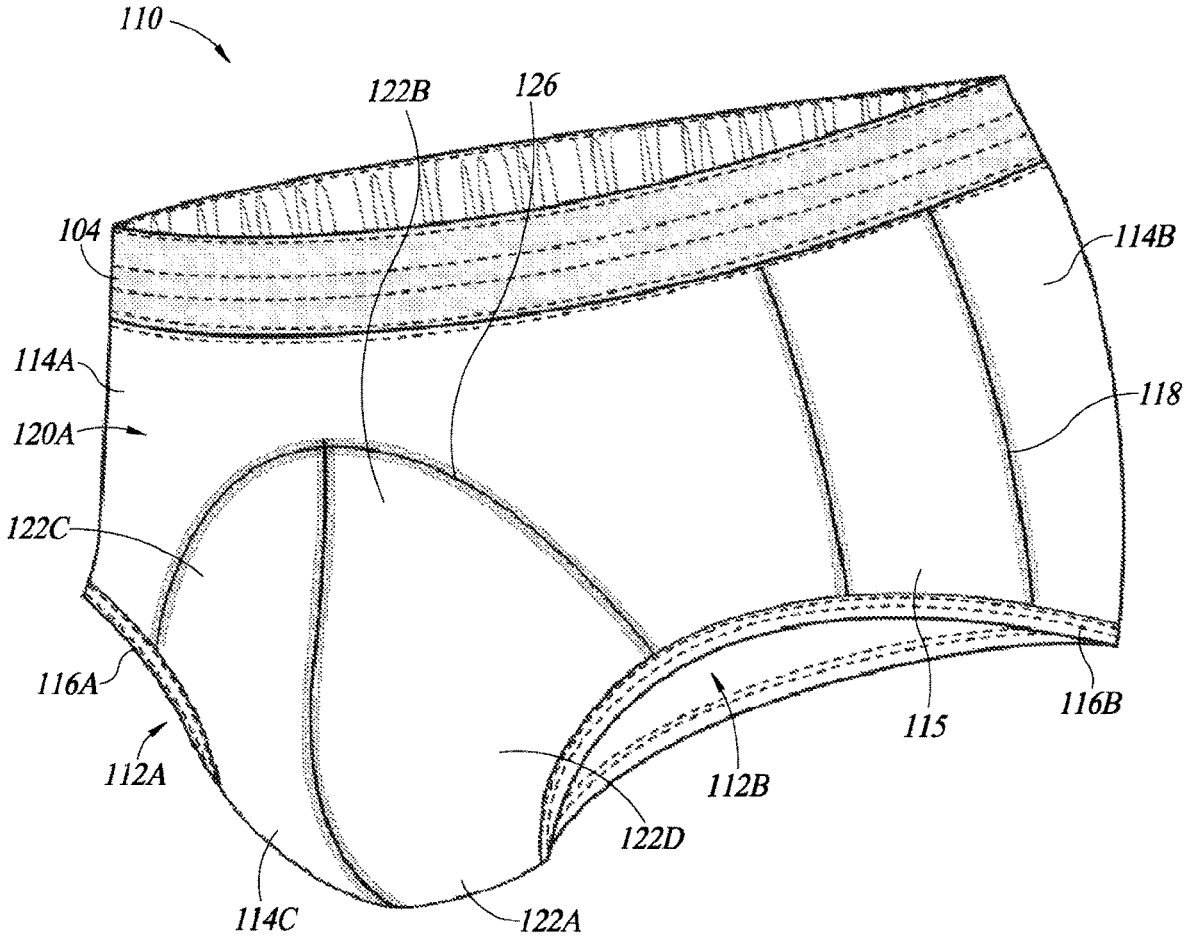
FIG. 3 is a front perspective view of the liner of FIG. 2.

FIG. 3 is a front perspective view of the liner 110 isolated from the outer shell 100 to provide additional detail regarding the liner 110. The liner 110 is generally formed from a number or plurality of different panels that are stitched or otherwise coupled together. In particular, the liner 110 may include at least a first panel 114A and a second panel 114B. In various embodiments, the first panel 114A is a front panel and the second panel 114B is a rear panel. The first panel 114A and the second panel 114B are coupled to the outer shell 102 at the waistband 104. The panels 114A, 114B are also coupled to each other, as further described below, and cooperate to define the openings 112A, 112B through the liner 110. The panels 114A, 114B may generally comprise a majority of the area of the liner 110 with the panels 114A, 114B meeting at an interface on sides of the liner 110, such as at left and right sides of the liner 110.

Alternatively, and as shown in FIG. 3, the first panel 114A may be coupled to a side panel 115 that is in turn coupled to the second panel 114B. Thus, the side panel 115 extends between, and is coupled to, the first and second panels 114A, 114B. Although not shown in FIG. 3, the liner 110 may include a side panel 115 on the opposite side (or left side in the orientation of FIG. 3) of the liner 110 as well. In various embodiments, the liner 110 may include the side panel 115 on only one side of the liner 110. The liner 110 may further include a first hem 116A around the first opening 112A and a second hem 116B around the second opening 112B as well as side seams 118. The side seams 118 couple the first panel 114A to the second panel 114B, or couple the first panel 114A, the side panel 115, and the second panel 114B to each other. Further, the side seams 118 extend in a generally vertical manner from the waistband 104 to the hems 116A, 116B around the openings 112A, 112B through the liner 110. Because of the curvature of the openings 112A, 112B, a length of each of the side seams 118 from the waistband 104 to the corresponding hem 116A, 116B may be different. A third panel 114C is coupled to the first panel 114A and generally faces outward away from the user and toward the outer shell 102 (FIG. 2), as described further below.

Figure 4A:
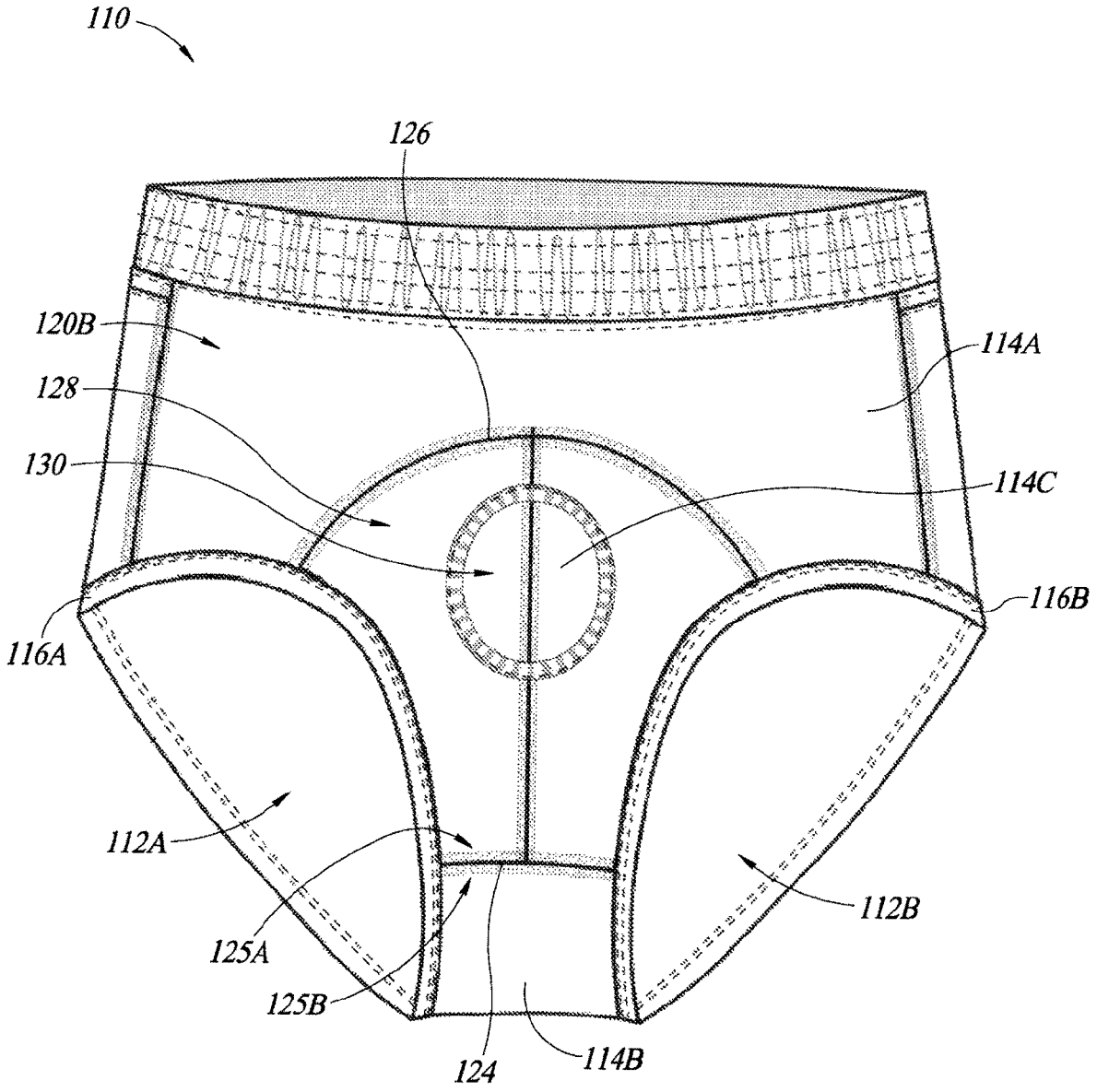
FIG. 4A is a front elevational view of the liner of FIG. 3 in a reversed orientation.

FIG. 4A is a front elevational view of the liner 110 in a reversed orientation. In other words, the liner 110 in FIG. 4A is turned inside out relative to the orientation in FIG. 3 to demonstrate additional features of the interior of the liner 110. With reference to FIG. 4A and continuing reference to FIG. 3, the first panel 114A has a first surface 120A and a second surface 120B opposite to the first surface 120A. The first surface 120A may be a front or outer surface facing away from the user and toward the outer shell 102 (FIG. 2) that is best shown in FIG. 3. The second surface 120B of the first panel 114A may be a rear or inner surface facing toward the user and away from the outer shell 102 (FIG. 2) that is best shown in FIG. 4A.

The liner 110 further includes the third panel 114C coupled to the first surface 120A of the first panel 114A and to the second panel 114B. In particular, the third panel 114C has a first side 122A, a second side 122B opposite to the first side 122A, a third side 122C between the first side 122A and the second side 122B, and a fourth side 122D opposite to the third side 122C. In the orientation shown in FIG. 3, the first side 122A of the third panel 114C is a bottom side, the second side 122B is a top side, the third side 122C is a left side, and the fourth side 122D is a right side. The first side 122A of the third panel 114C may be rectilinear or substantially horizontal and extend between the openings 112A, 112B through the liner 110. The second side 112B is curved and extends in a continuous arc from the first opening 112A and toward the waistband 104 before turning to curve back to the second opening 112B. The third side 122C and the fourth side 122D have a size and a shape corresponding to a curvature of the openings 112A, 112B, respectively.

The first side 122A of the third panel 114C is coupled to the second panel 114B at a first seam 124 best shown in FIG. 4A. The first seam 124 is located at an interface between the first panel 114A and the second panel 114B and may couple the first panel 114A, the second panel 114B, and the third panel 114C to each other. Further, both the first panel 114A and the second panel 114B include a portion of material 125A, 125B, respectively, that extends between the openings 112A, 112B. The portions of material 125A, 125B may be a narrowest region of each of the panels 114A, 114B between the openings 112A, 112B in various embodiments. As shown in FIG. 4A, the first seam 124 extends across the portion of material 125A, 125B of each of the first and second panels 114A, 114B that is positioned between the openings 112A, 112B. Specifically, the first seam 124 extends between the openings 112A, 112B proximate a bottom of the openings 112A, 112B. During use, the first seam 124 is structured to be located proximate at least a portion of a perineum of a user. In other words, the position of the first seam 124 is selected to be located proximate a perineum of a user, with the benefits of this location of the first seam 124 explained in more detail below.

The second side 122B of the third panel 114C is coupled to the first panel 114A at a second seam 126 that generally follows the shape of the second side 122B described above. The second seam 126 is therefore located at an interface between a top of the third panel 114C and surface of the first panel 114A in various embodiments, such as a middle surface located below the waistband 104 and above an upper-most extent of the openings 112A, 112B. The third side 122C and the fourth side 122D of the third panel 114C are also coupled to the first panel 114A at the hems 116A, 116B around the openings 112A, 112B, respectively. Thus, the third panel 114C is coupled to the first and second panels 114A, 114B on all exterior sides of the third panel 114C to define a pouch 128 between the first panel 114A and the third panel 114C. Three of the sides of the third panel 114C are preferably curved with one side being rectilinear or horizontal, although the same is not necessarily required and the third panel 114C can have a selected shape. The pouch 128 includes an opening 130 through the first panel 114A leading into, and providing access to, the pouch 128. More specifically, FIG. 4A shows the opening 130 through the first panel 114A with a portion of the third panel 114C visible through the opening 130. The opening 130 may be bordered by a flat lock seam, an overlock edge finish, a non-sewn finish (such as accomplished by use of textile welding, adhesives, or film applications), and/or other suitable finished edge. Additional detail regarding the pouch 128 is provided with reference to FIG. 4C below.

Figure 4B:
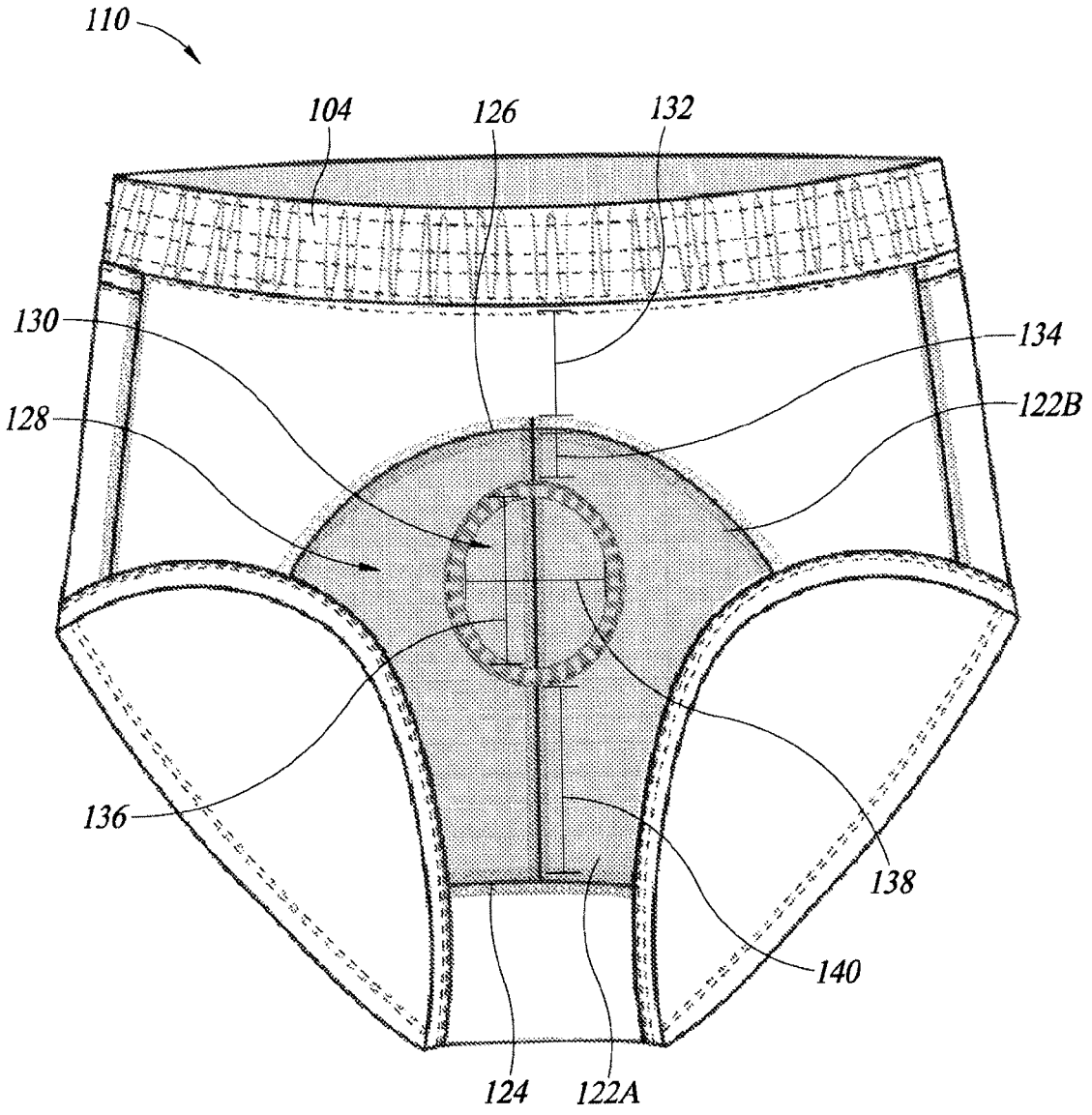
FIG. 4B is a front elevational view of a pouch of the liner of FIG. 4A.

FIG. 4B is the same view of the liner 110 from FIG. 4A, except the third panel 114C is shaded in grey for clarity. During use, the user inserts their genitalia through the opening 130 and into the pouch 128. The dimensions and arrangement of the pouch 128 and the opening 130 allow the genitalia to rest naturally while also preventing the genitalia from falling out of the pouch 128. Because the pouch 128 generally extends around the genitalia, the genitalia are separated from the inner thigh of the user to prevent chafing and other irritation during use. As a result, the dimensions of the pouch 128, the locations of the first and second seams 124, 126, and the size of the opening 130 are important features of the disclosure in preferred embodiments. Although the dimensions can generally be selected and should not be limited to the dimensions discussed below, it has been found that certain ranges of dimensions are advantageous over others. For example, if the opening 130 is located lower than that described herein, there is an increased chance that the opening 130 will not align with the genitalia of the user and will therefore be uncomfortable. Similarly, if the opening 130 is widened, there is an increased likelihood the genitalia will fall out of the pouch 128. Although the opening 130 is depicted symmetrically in FIG. 4B for ease of drawing, a width 138 of the opening may be less than a height 136 of the opening 130.

In various embodiments, and working across the liner 110 from the top to the bottom in the orientation shown in FIG. 4B, the liner 110 has a first dimension 132 from a bottom of the waistband 104 to a top of the second seam 126 in a range of approximately 3 inches to approximately 3.75 inches. A second dimension 134 of the liner 110 from the top of the second seam 126 to a top of the opening 130 is in a range of approximately 1.375 inches to approximately 1.5 inches. The opening 130 has a height 136 in a range of approximately 4.125 inches to 4.375 inches and a width 138 of approximately 2.125 inches. Further, a third dimension 140 from a bottom of the opening 130 to the first seam 124 is in a range of 1.1875 inches to 1.8333 inches. The third dimension 140 may also correspond to a portion of the pouch 128 that supports the genitals, and in particular, the base of the scrotum of the user during use. In other words, the location of the opening 130 allows the genitals to rest naturally while also providing adequate support to avoid discomfort during use.

The above ranges of dimensions may depend on the size of the garment incorporating the liner 110. For example, where the liner 110 is for an extra-small garment, the first dimension 132 may be 3 inches, but if the liner 110 is for an extra-large garment, the first dimension 132 may be 3.75 inches. Additional sizes are contemplated herein and thus the dimensions above include dimensions greater or less than the values stated. In addition, each of the ranges includes all intervening values to four decimal places.

Figure 4C:
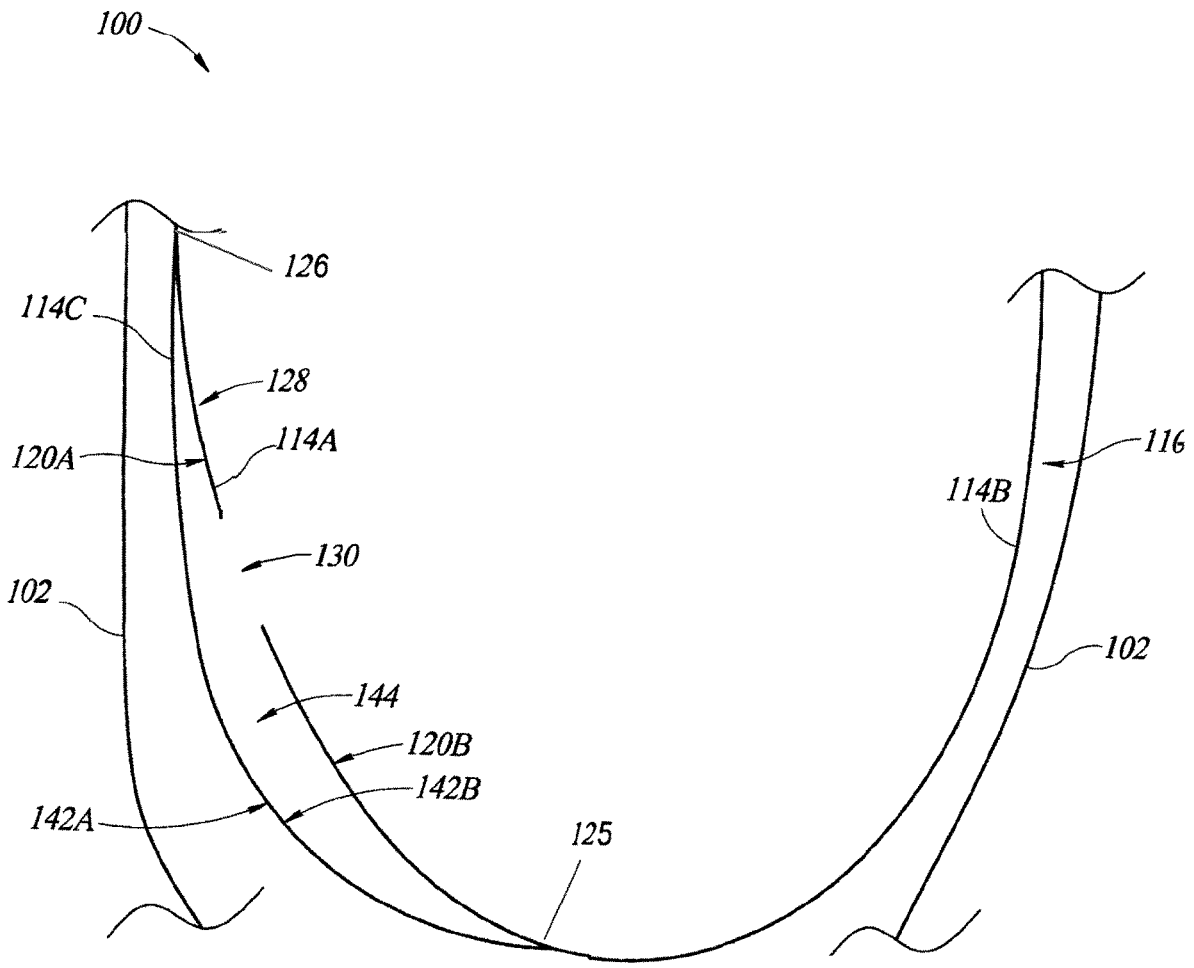
FIG. 4C is a schematic cross-sectional view of the garment of FIG. 1A along line A-A in FIG. 1A.

FIG. 4C is a schematic cross-sectional view of the garment 100 along line A-A in FIG. 1A. The pouch 128 of the liner 110 is external, meaning that the first panel 114A is aligned with, and cooperates with, the second panel 114B to define the interior boundary of the liner 110 with the third panel 114C and the pouch 128 facing the outer shell 102. In more detail, the first surface 120A of the first panel 114A faces the third panel 114C and generally faces toward the outer shell 102 and the second surface 120B of the first panel 114A faces the away from the outer shell 102 and toward the second panel 114B. The third panel 114C includes a first surface or outer surface 142A facing the outer shell 102 and a second or inner surface 142B facing the first panel 114A, as shown in FIG. 4C. Thus, the third panel 114C is between the outer shell 102 and the first panel 114C. Further, the first panel 114A and the second panel 114B cooperate to define interior surfaces of the liner 110 that face the user and may otherwise have an appearance that is similar to a conventional liner except for the opening 130 and the seams 124, 126. The third panel 114C is positioned external to the first and second panels 114A, 114B such that the pouch 128 is likewise external to the liner 110. In other words, in various embodiments, the first and second panels 114A, 114B define boundaries of the liner 110 with the third panel 114C being external to, and coupled to, the liner 110 and positioned between the liner 110 and the outer shell 102. The first panel 114A and the third panel 114C are separated by a gap 144 inside the pouch 128 with the opening 130 extending through the second surface 120B of the first panel 114A and leading into the gap 144.

As noted above, the first panel 114A is aligned with, and coupled to, the second panel 114B such that the first panel 114A and second panel 114B define internal boundaries of the liner 110. Accordingly, the third panel 114C extends away from the first panel 114A to define the gap 144 that receives the genitals of the user. Thus, the liner 110 of the present disclosure achieves separation of the genitals from the inner thigh by providing an external cavity or gap 144 in the liner 110 that allows the genitals to rest naturally while the garment 100 is in use. Moreover, the pouch 128 being external to the liner 110 reduces the likelihood that the genitals will fall out of the pouch 128 because the genitals are prevented from moving backwards and falling out of the opening 130 by the user's body and typical motion.

Figure 5:
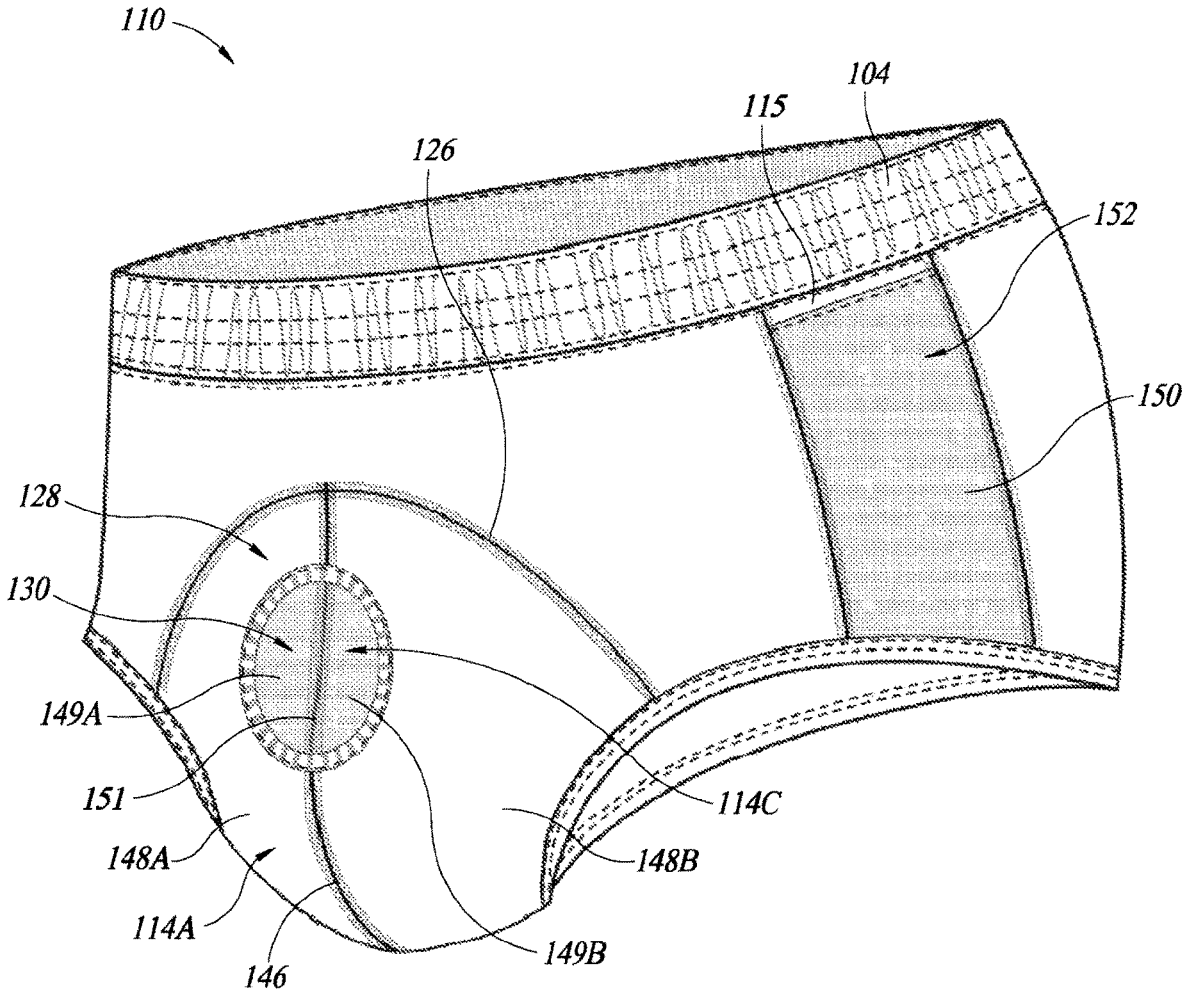
FIG. 5 is a front perspective view of the liner of FIG. 4A in the reversed orientation.

FIG. 5 is a front perspective view of the liner 110 in the reversed orientation showing the opening 130 of the pouch 128 shaded in grey for clarity. A portion of the third panel 114C is visible through the opening 130. As can be seen from FIG. 5, the first panel 114A defines an interior surface of the liner 110 that faces the user. As described above with reference to FIG. 4C, the pouch 128 is external to the liner 110 with the structure of the third panel 114C at the pouch 128 enabling extension of the third panel 114C away from the first panel 114A to form the pouch 128. In various embodiments, the first panel 114A includes a generally vertical seam 146 that extends along the first panel 114A from the first seam 124 (FIG. 4A) to a bottom of the opening 130 and from a top of the opening 130 to the second seam 126. In other words, the first panel 114A includes a first portion of material 148A and a second portion of material 148B joined together at the vertical seam 146 (e.g., arranged laterally on either side of the vertical seam 146).

In various embodiments, the first and second portions of material 148A, 148B of the first panel 114A are identical mirror images with the vertical seam 146 traversing through a center of the first panel 114A at the pouch 128 and the opening 130 extending through the first panel 114A and centered with respect to the vertical seam 146. The third panel 114C may be a single piece of material, or the third panel 114C may also include first and second portions 149A, 149B joined together at a pouch seam 151, e.g., which may be generally aligned with the vertical seam 146 of the first panel 114A, except the pouch seam 151 of the third panel 114C extends from the second seam 126 to the first seam 124 (FIG. 4A) and across the opening 130. In other words, the pouch seam 151 may extend from a bottom to a top of the third panel 114C in some embodiments. Utilizing one or more multi-portioned panels joined by one or more vertical seams (such as the first and second portions of material 148A, 148B of the first panel 114A joined by the vertical seam 146 and/or the first and second portions 149A, 149B of the third panel 114C joined by the vertical seam 151) may facilitate shaping of the pouch 128 to accommodate dimensions of the genitalia. For example, including the vertical seam 146 and/or 151 may allow suitable amounts of material to be provided (e.g., within an area bounded by the seams 124, 126 and hems 116A, 116B) to impart a contour to the pouch 128 and/or to otherwise cause a three-dimensional space defined between the outer or first surface 120A of the first panel 114A and the inner or second surface 142B of the third panel 114C to be of sufficient size and shape to accommodate dimensions of the genitalia in use. The liner 110 may further include a side pocket panel 150 coupled to the side panel 115 (FIG. 3) to form a side pocket 152 (e.g., a receptacle) shaded in FIG. 5 in grey. The side pocket 152 may form a receptacle coupled to the first panel 114A and to the second panel 114B at an interface between the first panel 114A and the second panel 114B. Although not shown in FIG. 5, the opposite side of the liner 110 may likewise include an identical side pocket panel and side pocket. Thus, during use, the user can store an identification card, a payment card, a key, a gel pouch for consumption during exercise, or other suitably sized item or items in the side pockets 152. The top of the side pocket panel 150 is positioned slightly below the bottom of the waistband 104 to enable a user to more easily access the side pocket 152. Placement of the side pocket panel 150 along an inward-facing surface of the liner 110 in use may allow the user's body to act as an additional barrier along an opening of the side pocket 152 and provide better securement against inadvertent dislodgement of contents during physical activity compared to if the opening for the side pocket 152 were instead on an external side of the liner 110.

Figure 6:
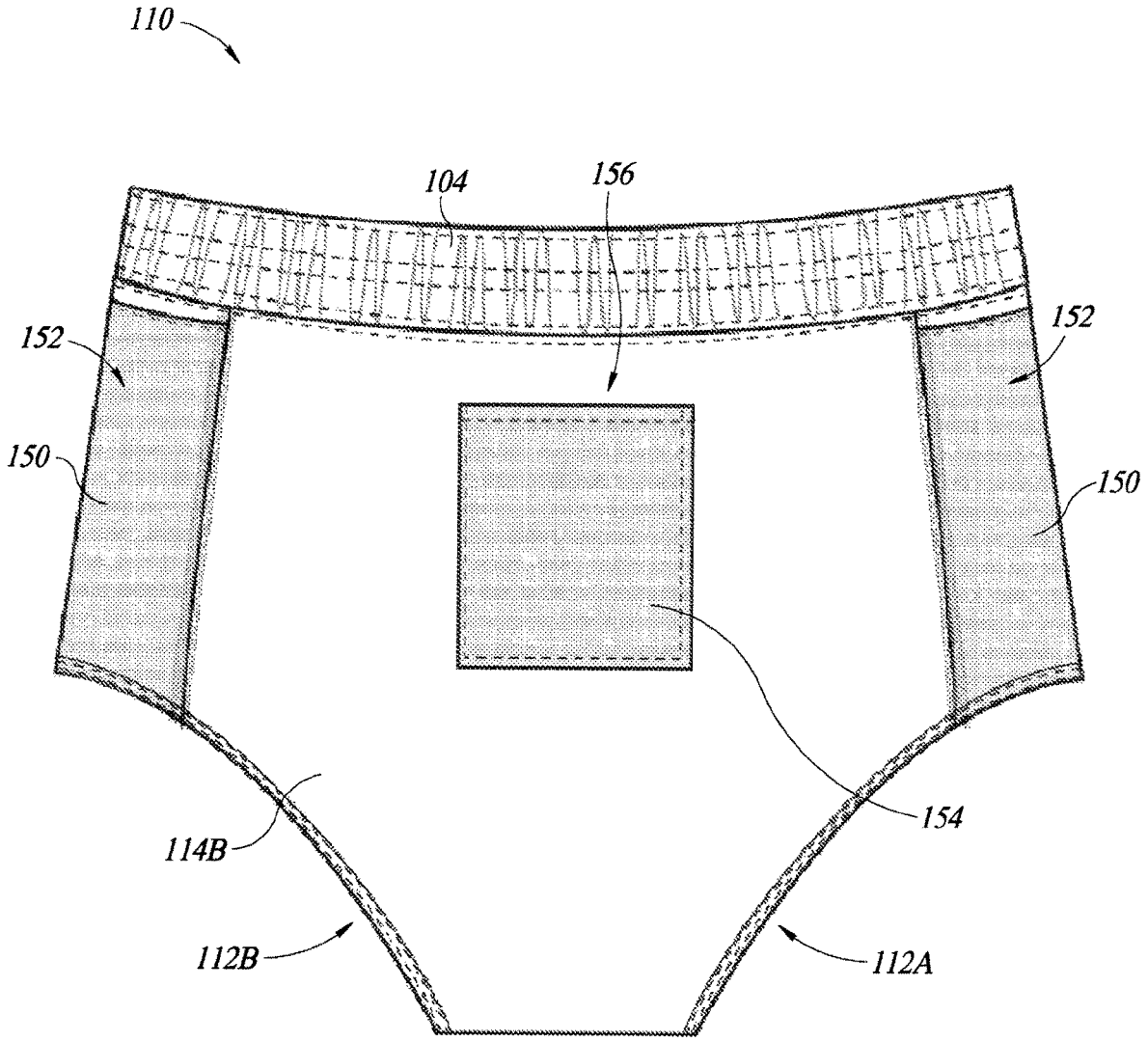
FIG. 6 is a rear elevational view of the liner of FIG. 4A in the reversed orientation.

FIG. 6 is a rear elevational view of the liner of FIG. 4A in the reversed orientation providing more detail regarding the second panel 114B. As shown in FIG. 6, the liner 110 may include side pocket panels 150 to form side pockets 152 on both the left and right sides of the liner 110. Further, the liner 110 may include a back pocket panel 154 coupled to the second panel 114B to define a back pocket 156. The back pocket panel 154 may have a different shape and location relative to the waistband 104 than the side pocket panels 150. For example, the back pocket panel 154 may generally be square or rectangular while the side pocket panels 150 have at least one curved edge corresponding to the curvature of the openings 112A, 112B through the liner 110. The back pocket panel 154 may also have a smaller surface area than the side pocket panels 150 and be positioned further from the bottom of the waistband 104 than the side pocket panels 150. In some embodiments, the back pocket panel 154 is identical to, and aligned with, the side pocket panels 150. The back pocket 156 may have a different size and shape than the side pockets 152 in order to enable storage of different items. For example, the back pocket 156 may be designed to store a small key while the side pockets 152 store a larger key or set of keys and/or other larger items.

Figure 7:
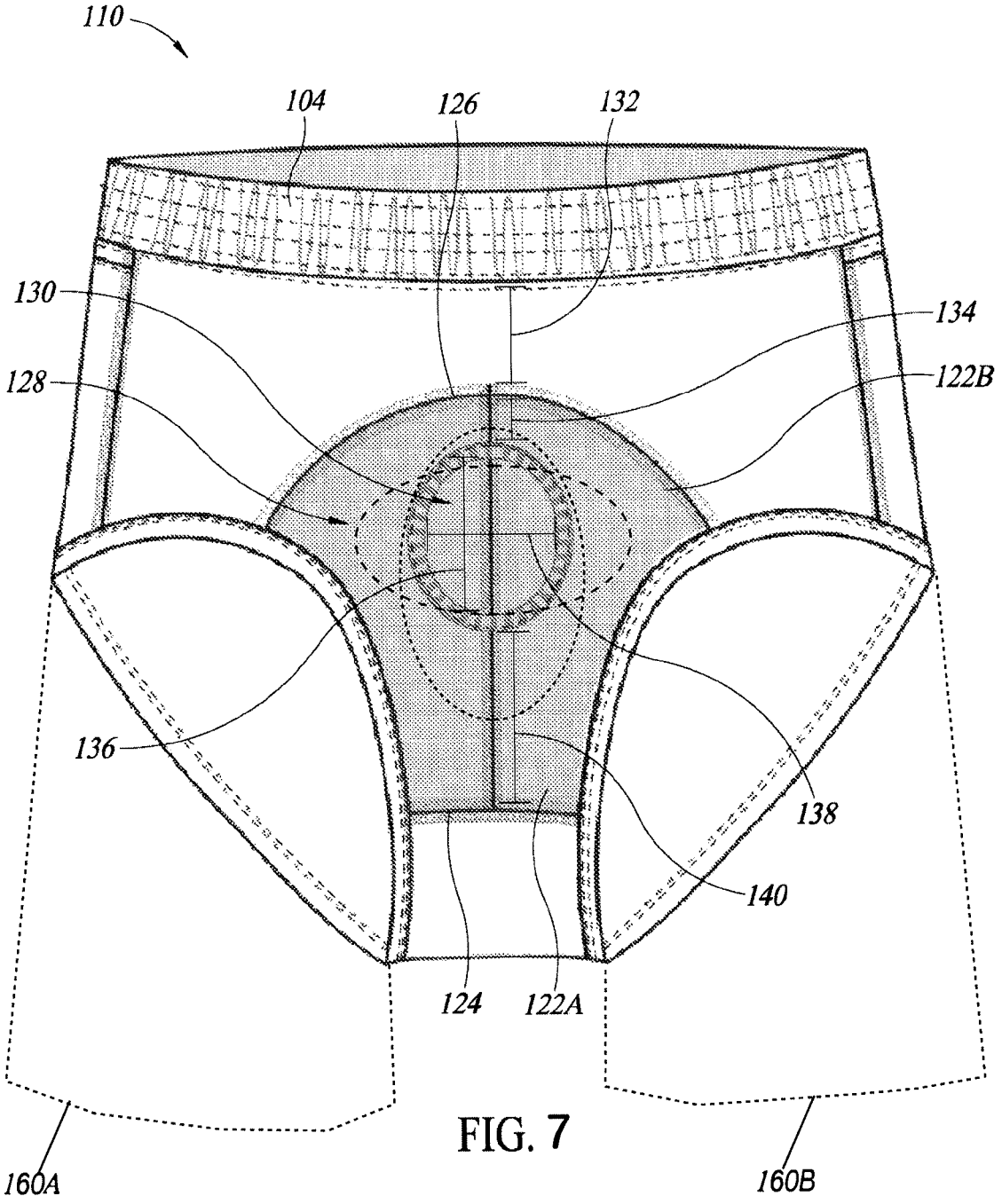
FIG. 7 is a front elevational view of the liner in a reversed orientation and showing further options of features that may be incorporated in the liner.

Other variations are also within the scope of the present disclosure. Some further examples are provided with respect to FIG. 7. FIG. 7 is the same view of the liner 110 from FIG. 4B, except some examples of variations are also denoted in broken lines. Although the liner 110 in other figures herein is primarily shown in a form factor of a brief, the disclosure herein is not so limited. As one example, the liner 110 may include leg extensions 160A, 160B that may correspond to a form factor of boxers or boxer briefs. For example, leg extensions 160A, 160B may correspond to tubes or other suitable passages through which a user can insert their legs when also inserting legs through the openings 106A, 106B of the liner 110 for donning the liner 110. The leg extensions 160A, 160B can extend downward from a groin area of the liner 110. For example, the leg extensions 160A, 160B may be sized to be shorter than the outer shell 102 of the garment 100 (e.g., so as to be primarily hidden or obscured from view in use). The leg extensions 160A, 160B may be tapered or otherwise of suitable sizing and/or material so as to be formfitting for a wearer (e.g., consistent with a boxer brief form factor) or to be non-formfitting (e.g., consistent with a boxer form factor).

Although the liner 110 in other figures herein is primarily shown with a circular shape for the opening 130, oval or other suitable shapes may be utilized in some embodiments. In some examples, an oval shape may include or encompass an elliptical shape. In some examples, an oval shape of the opening 130 may be arranged so a major axis is aligned vertically and a minor axis is aligned horizontally (such as depicted by the example shown in short dashed lines in FIG. 7). In some examples, an oval shape of the opening 130 may be arranged so a major axis is aligned horizontally and a minor axis is aligned vertically (such as depicted by the example shown in long dashed lines in FIG. 7). An oval shape for the opening 130 may have or be associated with dimensions in which the major axis or the minor axis is equal to, greater, or smaller than dimensions described previously with respect to FIG. 4B regarding the height 136 and/or width 138 of the opening 130, and/or the oval shape for the opening 130 may be arranged so as to match or differ from relative dimensions described with respect to FIG. 4B with respect to distances relative the first seam 124, the second seam 126, and/or other features.

Thus, the present disclosure provides for a garment and a garment liner with an external pouch that allows genitalia to rest naturally while being separated from the user's inner thigh. In addition, the design of the pouch reduces the likelihood that the genitalia of the user will fall out of the pouch while also providing support for the genitalia to prevent seams from causing the user discomfort.

In view of the above, one or more embodiments of a garment may be summarized as including: an outer shell; and a liner coupled to the outer shell and arranged inside the outer shell, the liner including a first panel coupled to the outer shell, a second panel coupled to the outer shell, a first seam at an interface between the first panel and the second panel, the first seam configured to be located proximate a perineum of a user, a third panel coupled to the second panel at the first seam, a second seam at an interface between the first panel and the third panel, a pouch defined at least in part by the first panel and at least in part by the third panel, and an opening through the first panel into the pouch.

In at least one embodiment, the first panel and the second panel define at least a portion of an interior surface of the liner, the pouch being external to the interior surface.

In at least one embodiment, the second seam is located closer to an interface between the outer shell and the first panel of the liner than to the first seam.

In at least one embodiment, the garment further includes a back pocket coupled to the second panel and positioned proximate an interface between the second panel and the outer shell.

In at least one embodiment, the garment further includes a side pocket coupled to the first panel and to the second panel at an interface between the first panel and the second panel proximate a location where the first panel and the second panel meet the outer shell.

In at least one embodiment, the first seam is rectilinear and the second seam is curved.

In at least one embodiment, the third panel is between the outer shell and the first panel.

In at least one embodiment, the opening through the first panel has a height and a width less than the height.

In at least one embodiment, a bottom of the opening through the first panel is spaced from the first seam by a first distance and a top of the opening through the first panel is spaced from the second seam by a second distance greater than or less than the first distance.

One or more embodiments of a garment may be summarized as including: a liner brief, including a first panel, a second panel coupled to the first panel, a first opening defined by the first panel and the second panel, a second opening defined by the first panel and the second panel, the second opening spaced from the first opening across a lower portion of the first panel and a lower portion of the second panel, a first hem around the first opening, a second hem around the second opening, a first seam at an interface between the first panel and the second panel extending from the first hem to the second hem across the lower portion of the first panel and the lower portion of the second panel between the first opening and the second opening, a third panel coupled to the second panel at the first seam, the third panel having a first surface and a second surface opposite to the first surface, the first surface of the third panel facing away from the first panel and the second surface of the third panel facing the second panel, a second seam at an interface between the first panel and the third panel, a pouch defined at least in part by the first panel and at least in part by the third panel, and an opening through the first panel into the pouch.

In at least one embodiment, the garment further includes a shell coupled to the liner brief, the shell including a first opening and a second opening, the first opening of the shell aligned with the first opening of the liner and the second opening of the shell aligned with the second opening of the liner.

In at least one embodiment, the third panel is between the shell and the first panel with the opening in the first panel facing the second panel.

In at least one embodiment, the garment further includes a pocket coupled to an upper portion of the second panel.

In at least one embodiment, the garment further includes a receptacle coupled to the first panel and to the second panel at an interface between the first panel and the second panel.

In at least one embodiment, the garment further includes a third seam along the first panel from the first seam to the opening and a fourth seam along the first panel from the opening to the second seam.

In at least one embodiment, the garment further includes a fifth seam along the third panel from the first seam to the second seam.

In at least one embodiment, the opening through the first panel is centered on the first panel with respect to the first hem and the second hem.

In at least one embodiment, the opening through the first panel is positioned closer to the first seam than the second seam.

In at least one embodiment, the first hem is curved, the second hem is curved, the first seam is rectilinear, and the second seam is curved.

One or more embodiments of a garment may be summarized as including: a liner brief including a first panel and a second panel coupled to the first panel; a pouch coupled to the liner brief, including a third panel coupled to the first panel and the second panel with the pouch defined at least in part by the first panel and the third panel, the pouch being external to the liner brief; and an opening through the first panel of the liner brief leading into the pouch.

In at least one embodiment, the garment further includes an outer shell coupled to the liner brief, the third panel being positioned between the outer shell and the first panel.

In the above description, certain specific details are set forth in order to provide a thorough understanding of various embodiments of the disclosure. However, one skilled in the art will understand that the disclosure may be practiced without these specific details. In other instances, well-known structures associated with garments, garment liners, briefs, and running shorts have not been described in detail to avoid unnecessarily obscuring the descriptions of the embodiments of the present disclosure.

Certain words and phrases used in the specification are set forth as follows. As used throughout this document, including the claims, the singular form "a", "an", and "the" include plural references unless indicated otherwise. Any of the features and elements described herein may be singular, e.g., a die may refer to one die. The terms "include" and "comprise," as well as derivatives thereof, mean inclusion without limitation. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this disclosure.

The use of ordinals such as first, second, third, etc., does not necessarily imply a ranked sense of order, but rather may only distinguish between multiple instances of an act or a similar structure or material.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other derivatives thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. The term "based on" is not exclusive and allows for being based on additional features, functions, aspects, or limitations not described, unless the context clearly dictates otherwise. In addition, throughout the specification, the meaning of "a," "an," and "the" include singular and plural references.

Generally, unless otherwise indicated, the materials for making the invention and/or its components may be selected from appropriate materials such as fabric, textiles, composite materials, ceramics, plastic, metal, polymers, foam, plastic compounds, and the like.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

The terms "top," "bottom," "upper," "lower," "left," "right," and other like derivatives are used only for discussion purposes based on the orientation of the components in the Figures of the present disclosure. These terms are not limiting with respect to the possible orientations explicitly disclosed, implicitly disclosed, or inherently disclosed in the present disclosure and unless the context clearly dictates otherwise, any of the aspects of the embodiments of the disclosure can be arranged in any orientation.

As used herein, the term "substantially" is construed to include an ordinary error range or manufacturing tolerance due to slight differences and variations in manufacturing. Unless the context clearly dictates otherwise, relative terms such as "approximately," "substantially," and other derivatives, when used to describe a value, amount, quantity, or dimension, generally refer to a value, amount, quantity, or dimension that is within plus or minus 5% of the stated value, amount, quantity, or dimension. It is to be further understood that any specific dimensions of components or features provided herein are for illustrative purposes only with reference to the various embodiments described herein, and as such, it is expressly contemplated in the present disclosure to include dimensions that are more or less than the dimensions stated, unless the context clearly dictates otherwise.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described embodiments, but should be defined only in accordance with the following claims and their equivalents.

What is claimed is:

1. A garment, comprising:

an outer shell; and a liner coupled to the outer shell and arranged inside the outer shell, the liner including:

a first panel coupled to the outer shell;

a second panel coupled to the outer shell;

a first seam at an interface between the first panel and the second panel, the first seam configured to be located proximate at least a portion of a perineum of a user;

a third panel coupled to the second panel at or nearby the first seam;

a second seam at an interface between the first panel and the third panel;

a pouch defined at least in part by the first panel and at least in part by the third panel; and an opening through the first panel into the pouch.

2. The garment of claim 1, wherein the first panel and the second panel define at least a portion of an interior surface of the liner, the pouch being external to the interior surface.

3. The garment of claim 1, wherein the second seam is located closer to an interface between the outer shell and the first panel of the liner than to the first seam.

4. The garment of claim 1, further comprising:

a back pocket coupled to the second panel and positioned proximate an interface between the second panel and the outer shell.

5. The garment of claim 1, further comprising:

a side pocket coupled to the first panel and to the second panel at an interface between the first panel and the second panel proximate a location where the first panel and the second panel meet the outer shell.

6. The garment of claim 1, wherein the first seam is rectilinear and the second seam is curved.

7. The garment of claim 1, wherein the third panel is between the outer shell and the first panel.

8. The garment of claim 1, wherein the opening through the first panel has a height and a width less than the height.

9. A garment, comprising:

a liner brief, including:

a first panel;

a second panel coupled to the first panel;

a first opening defined by the first panel and the second panel;

a second opening defined by the first panel and the second panel, the second opening spaced from the first opening across a lower portion of the first panel and a lower portion of the second panel;

a first hem around the first opening;

a second hem around the second opening;

a first seam at an interface between the first panel and the second panel extending from the first hem to the second hem across the lower portion of the first panel and the lower portion of the second panel between the first opening and the second opening;

a third panel coupled to the second panel at the first seam, the third panel having a first surface and a second surface opposite to the first surface, the first surface of the third panel facing away from the first panel and the second surface of the third panel facing the first panel;

a second seam at an interface between the first panel and the third panel;

a pouch defined at least in part by the first panel and at least in part by the third panel; and an opening through the first panel into the pouch.

10. The garment of claim 9, further comprising:

a shell coupled to the liner brief, the shell including a first opening and a second opening, the first opening of the shell aligned with the first opening of the liner and the second opening of the shell aligned with the second opening of the liner.

11. The garment of claim 10 wherein the third panel is between the shell and the first panel, the opening in the first panel facing the second panel.

12. The garment of claim 9, further comprising:

a pocket coupled to an upper portion of the second panel.

13. The garment of claim 9, further comprising:

a receptacle coupled to the first panel and to the second panel at an interface between the first panel and the second panel.

14. The garment of claim 9, further comprising:

a third seam along the first panel from the first seam to the opening; and a fourth seam along the first panel from the opening to the second seam.

15. The garment of claim 14, further comprising:

a fifth seam along the third panel from the first seam to the second seam.

16. The garment of claim 15, wherein the third seam and the fourth seam are vertically aligned so as to be aligned for overlaying the fifth seam.

17. The garment of claim 9 wherein the opening through the first panel is centered on the first panel with respect to the first hem and the second hem.

18. The garment of claim 9 wherein the first hem is curved, the second hem is curved, the first seam is rectilinear, and the second seam is curved.

* * * * *